US007024891B2

(12) United States Patent
Huang et al.

(10) Patent No.: US 7,024,891 B2
(45) Date of Patent: Apr. 11, 2006

(54) LIFE VEST

(75) Inventors: Yung-Mao Huang, Taoyuan (TW); Ming-Lung Wu, Taoyuan (TW)

(73) Assignee: Trueway Corporation, Taoyuan (TW)

( * ) Notice: Subject to any disclaimer, the term of this patent is extended or adjusted under 35 U.S.C. 154(b) by 0 days.

(21) Appl. No.: 11/023,513

(22) Filed: Dec. 29, 2004

(65) Prior Publication Data

US 2005/0150257 A1 Jul. 14, 2005

(30) Foreign Application Priority Data

Jan. 12, 2004 (TW) ..... 093137019

(51) Int. Cl.
*D04B 1/22* (2006.01)

(52) U.S. Cl. ..... 66/176; 441/106

(58) Field of Classification Search ..... 66/169 R, 66/170, 171, 176, 202; 441/102, 106, 108
See application file for complete search history.

(56) References Cited

U.S. PATENT DOCUMENTS 5,184,968 A * 2/1993 Michalochick et al. ..... 441/116
5,413,837 A * 5/1995 Rock et al. ..... 428/192
5,693,412 A * 12/1997 Walters ..... 428/317.1
6,712,658 B1 * 3/2004 Crossley et al. ..... 441/106

* cited by examiner

*Primary Examiner*—Danny Worrell
(74) *Attorney, Agent, or Firm*—Rosenberg, Klein & Lee

(57) ABSTRACT

A method for making a life vest includes knitting or weaving, wherein a material including synthetic filament, synthetic monofilament and elastic yarn is combined by a double weft knitting machine to make a textile for the life vest, and dyeing and sewing. Appropriate cutting and sewing processes are employed to finish the formation of the life vest.

6 Claims, 3 Drawing Sheets

LIFE VEST

BACKGROUND OF THE INVENTION

1. Field of the Invention

The present invention relates to a life vest, and more particularly to the life vest that is made of synthetic filament, synthetic monofilament and elastic yarn. The synthetic filament is selected from a group consisting of polyester filament, polyamide filament or polypropylene filament. The synthetic monofilament is selected from a group consisting of polyester monofilament or polyamide monofilament. The elastic yarn concerns yarn that is of at least 20 denier.

2. Description of Related Art

Conventionally, the process for making a life vest as shown in FIG. 3 is first using a fabric to be processed by weaving or knitting (40). The knitted fabric is then treated with a dyeing process (41). Thereafter, the dyed fabric undergoes a lamination process (42) with rubber sponge. Finally, the semi-finished life vest undergoes a sewing process (43) to allow a floatation material to be sewed into the life vest to enable the life vest to be floatable.

With reference to FIG. 4, it is noted that after the conventional life vest is finished, a layer of rubber sponge (50) is sandwiched between two fabrics (51). It is well appreciated that rubber sponge (50) is elastic and hydrophobic so that it has long been the best choice for making the finished product have a strength that fully complies with the regulations. However, the life vest so made is bulky and heavy such that the wearer's movement is limited. Besides, the rubber sponge fabric sheets (the fabric (51) attached to the rubber sponge (50)) do not have a porous structure so that the wearer feels stuffy and uncomfortable especially on humid and hot summer days. Furthermore, the rubber sponge is easily affected by weather conditions such that without any post-manufacture care, it hardens due to exposure to light, heat, and so on. This hardening makes the vest uncomfortable, thereby leading to the dangerous situation where a sailor etc declines to wear the vest. To overcome the shortcomings, the present invention tends to provide an improved life vest to mitigate the aforementioned problems.

SUMMARY OF THE INVENTION

The primary objective of the present invention is to provide an improved life vest made of synthetic filament and synthetic monofilament. The life vest has great water repellency, floatation ability and structural strength.

In order to accomplish the aforementioned objective, the life vest of the present invention is made of synthetic filament, synthetic monofilament and elastic yarn.

The synthetic filament is selected from a group consisting of polyester filament, polyamide filament or polypropylene filament. The synthetic monofilament is selected from a group consisting of polyester monofilament or polyamide monofilament. The elastic yarn includes yarns of at least 20 denier.

Other objects, advantages and novel features of the invention will become more apparent from the following detailed description when taken in conjunction with the accompanying drawings.

DETAILED DESCRIPTION OF THE PREFERRED EMBODIMENT

Figure 1:
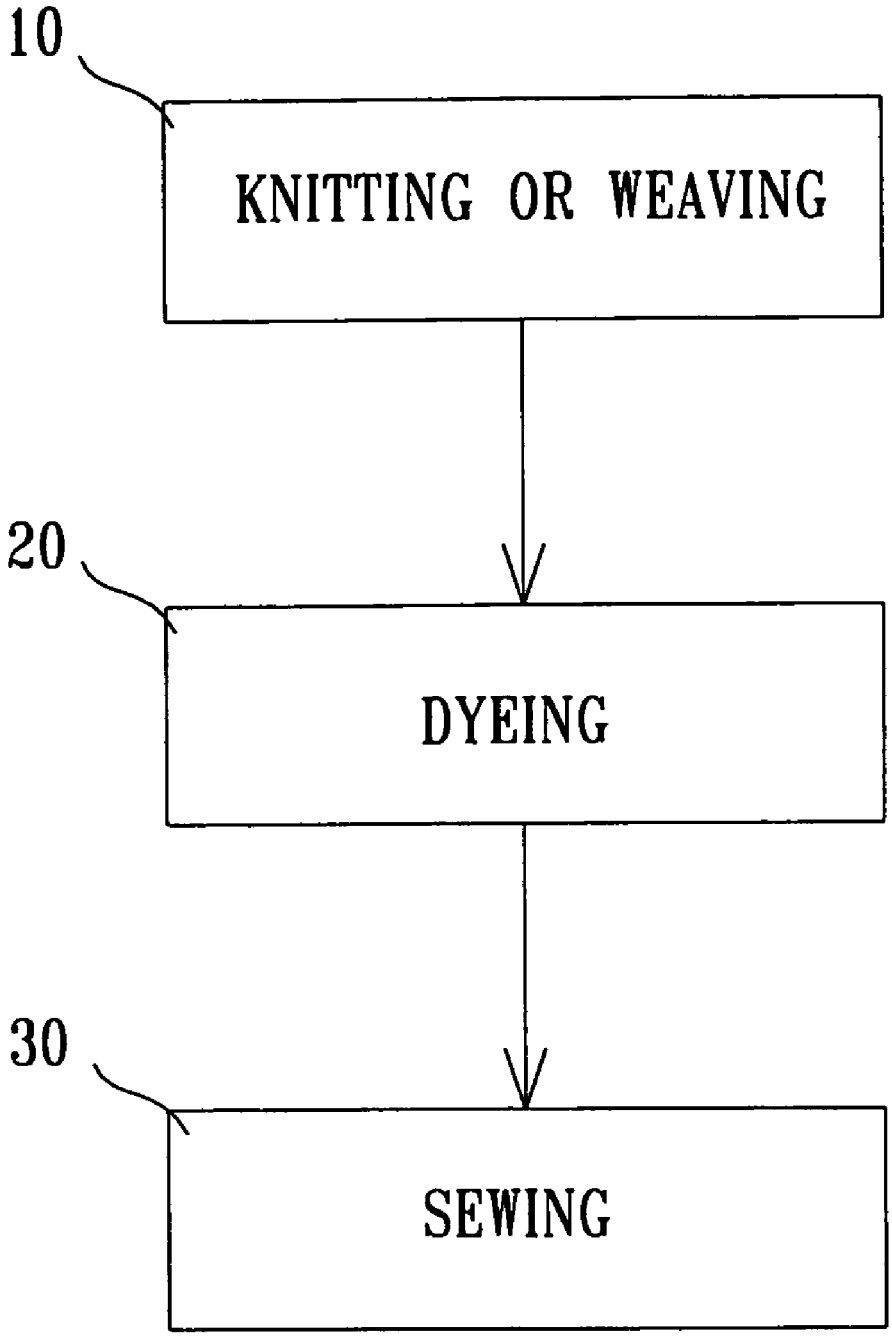
FIG. 1 is a flow chart showing the process for making a life vest of the present invention.

With reference to FIG. 1, the material for the life vest in accordance with the present invention includes synthetic filament, synthetic monofilament and elastic yarn. The synthetic filament is selected from a group consisting of polyester filament, polyamide filament or polypropylene filament. The synthetic monofilament selected from a group consisting of polyester monofilament or polyamide monofilament. The elastic yarn is yarn of at least 20 denier.

Figure 2:
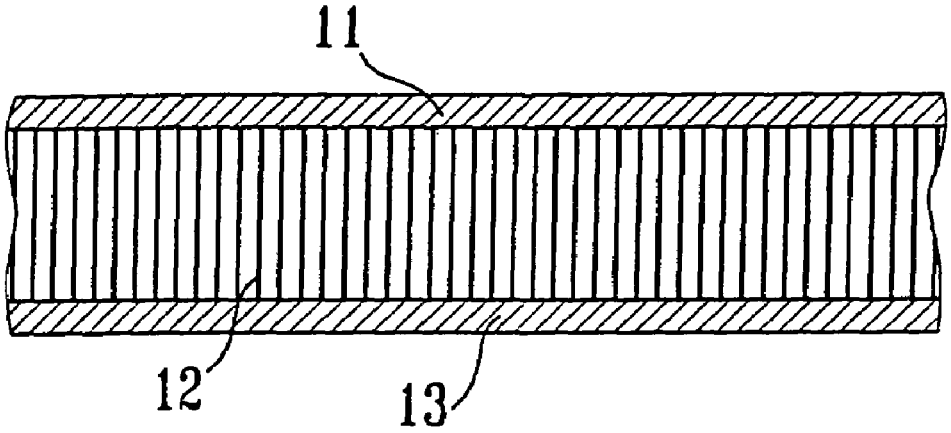
FIG. 2 is a cross sectional view showing the structure of the life vest of the present invention.
Figure 4:
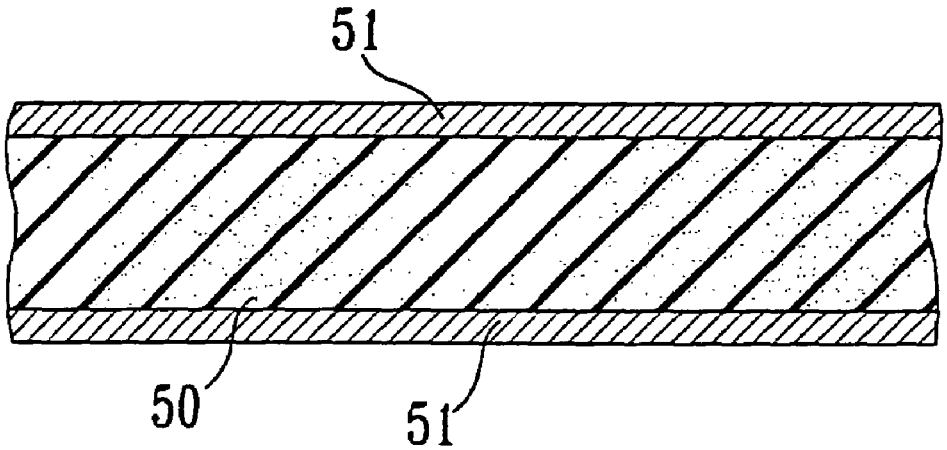
FIG.4 PRIOR ART
FIG. 4 is a cross sectional view showing the structure of the conventional life vest.
Figure 3:
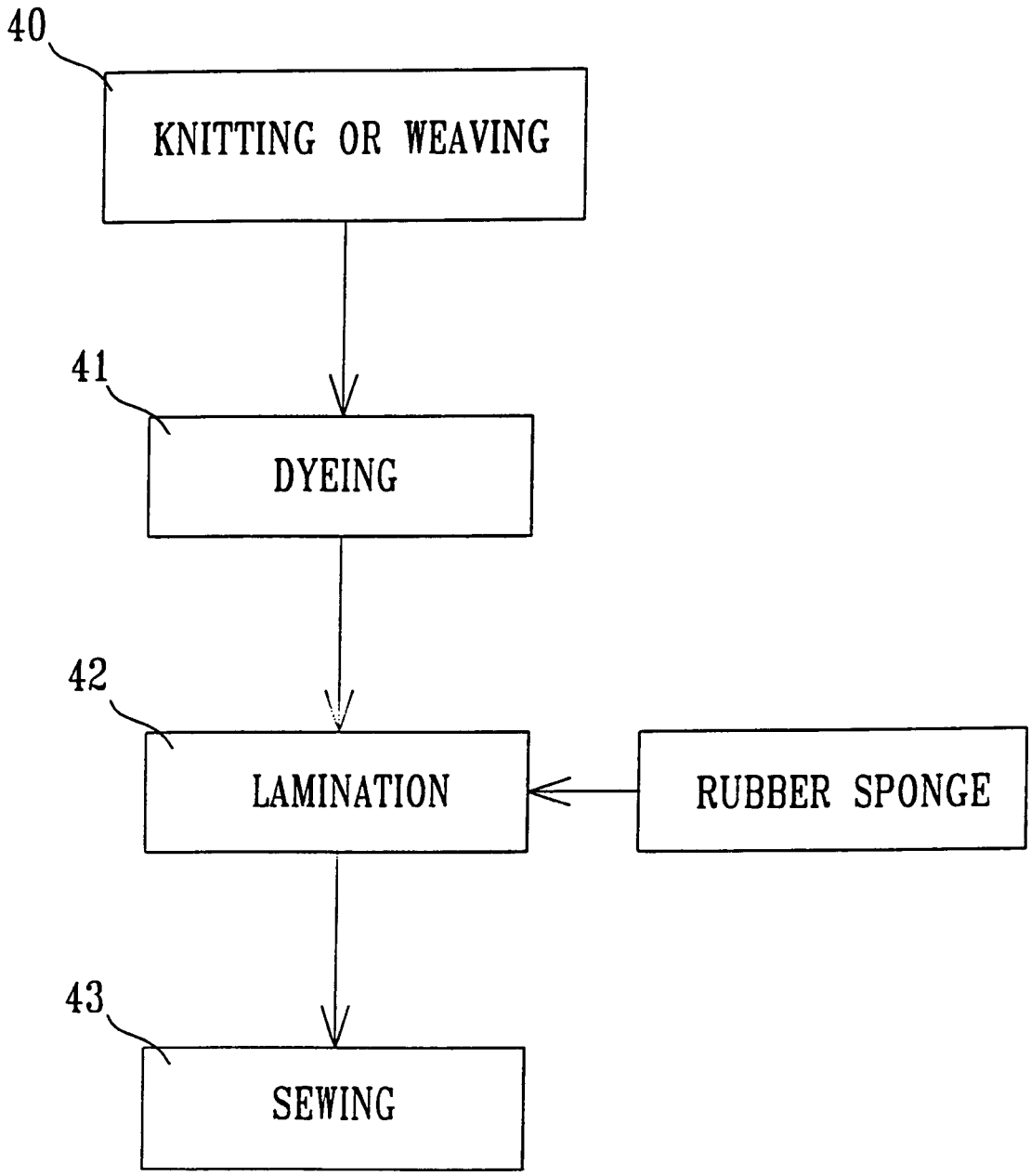
FIG.3 PRIOR ART
FIG. 3 is a flow chart showing the conventional process for making a life vest.

The process for making the life vest of the present invention includes weaving or knitting (10), dyeing (20) and sewing (30). The finished product has three layers, as shown in FIG. 2, namely the top layer (11), the middle layer (12) and the bottom layer (13). The top layer (11) and the bottom layer (13) are the combination of the synthetic filament and the elastic yarn. The middle layer (12) is the synthetic monofilament. The top layer (11), the middle layer (12) and the bottom layer (13) are combined by using the double weft knitting machine to have a thickness between 1.5 mm to 5 mm. The synthetic monofilament in the middle layer (12) is securely connected to both the top layer (11) and the bottom layer (13) and has large voids in-between so that the finished product is lightweight and has great ventilation effect.

The dyeing process provides the semi-finished product (three-layer fabric) features such as firm hand-feel, elasticity and water repellency. The structural strength (ball burst strength) is larger than 14 kgf/cm$^2$ and the weight is around 300 to 700 g/m$^2$. Experiments show the result that after immersing the finished product in the water for 60 mins, the weight increment is less than 100% and the water vaporization rate under room temperature for 30 mins is larger than 20%.

Following is an experiment to show the content of the product and the results after tests.

First, the synthetic filament of 75 denier and elastic yarn of 40 denier are respectively used as the material for the top layer and the bottom layer. The synthetic monofilament of 30 denier is used as the material for the middle layer. After treatment by the double weft knitting machine, dyeing process and appropriate cutting and knitting, the life vest in accordance with the present invention is finished.

A table is presented to show the differences between the finished textile of the life vest of the present invention and the rubber sponge fabric sheet for the conventional life vest.

| Item | | Textile of the present invention | Conventional structure | Testing method |
|---|---|---|---|---|
| Weight (g/m$^2$) | | 493 | 504 | |
| Ball burst strength (kgf/cm$^2$) | | 17 | 17 | ASTM3787 |
| Breaking elongation (%) | Warp | 271 | 191 | specimen 2.54 × 12 cm |
| | Weft | 164 | 230 | |
| Breaking strength (kg) | Warp | 31 | 36 | specimen 2.54 × 12 cm |
| | Weft | 39 | 32 | |

-continued

| Item | Textile of the present invention | Conventional structure | Testing method |
|---|---|---|---|
| Water absorbing rate (%) | 80 | 89 | water bath for 60 mins |
| Vaporization rate (%/30 min) | 30 | 13 | under room temperature for 30 mins |
| Ventilation | good | not good | — |
| Comfort | excellent | bad | — |
| Odor | no | yes | — |
| Application status | repeatable, long life span | easy to wear out and short life span | — |
| Environmental issue | no | pollutant | — |

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a life vest comprising the steps of:

establishing a synthetic polyamide monofilament layer sandwiched between a pair of layers of combined synthetic polyamide filament and elastic yarn;

knitting or weaving, said synthetic polyamide monofilament layer to said layer of synthetic polyamide filament and elastic yarn by a double weft knitting machine to make a textile for the life vest;

dyeing; and sewing, wherein appropriate cutting and sewing processes are employed to finish the formation of the life vest having voids in the synthetic monofilament.

2. The method as claimed in claim 1, wherein the synthetic filament is selected from a group consisting of polyester filament or polypropylene filament.

3. The method as claimed in claim 2, wherein the synthetic monofilament is a polyester monofilament.

4. The method as claimed in claim 3, wherein the elastic yarn is yarn of at least 20 denier.

5. The method as claimed in claim 4, wherein the textile is composed of a top layer, a bottom layer and a middle layer sandwiched between the top layer and the bottom layer, the top layer and the bottom layer are combination of synthetic filament and elastic yarn and the middle layer is synthetic monofilament, a thickness of the textile is 1.5 to 5.0 mm, ball burst strength of the textile is larger than 14 kgf/am$^2$ and the weight thereof is around 300 to 700 g/m$^2$.

6. A method for making a life vest comprising the steps of:

knitting or weaving, wherein a material including synthetic filament, synthetic monofilament and elastic yam is combined by a double weft knitting machine to make a textile for the life vest;

dyeing; and sewing, wherein appropriate cutting and sewing processes are employed to finish the formation of the life vest having voids in the synthetic monofilament;

wherein the textile is composed of a top layer, a bottom layer and a middle layer sandwiched between the top layer and the bottom layer, the top layer and the bottom layer are combination of synthetic filament and elastic yarn and the middle layer is synthetic monofilament, a thickness of the textile is 1.5 to 5.0 mm, ball burst strength of the textile is larger than 14 kgf/am$^2$ and the weight thereof is around 300 to 700 g/m$^2$;

said synthetic filament is selected from a group consisting of polyester filament, polyamide filament or polypropylene filament and said synthetic monofilament is selected from a group consisting of polyester monofilament or polyamide; and the elastic yarn is yarn of at least 20 denier.

* * * * *